United States Patent [19]

Leinhaas

[11] Patent Number: 4,577,791

[45] Date of Patent: Mar. 25, 1986

[54] GRIPPER FEED ADVANCE MECHANISM FOR A PRESS OR THE LIKE

[76] Inventor: Werner Leinhaas, Alte Leipziger Str. 40a, D-6460 Gelnhausen, Fed. Rep. of Germany

[21] Appl. No.: 604,729

[22] Filed: Apr. 27, 1984

[30] Foreign Application Priority Data

May 4, 1983 [EP] European Pat. Off. ..... 83710024.7

[51] Int. Cl.[4] ..... B65H 17/26

[52] U.S. Cl. ..... 226/142; 226/115; 226/150; 226/162

[58] Field of Search ..... 226/142, 158, 159, 137, 226/138, 139, 141, 112, 115, 167, 150, 162; 74/110

[56] References Cited

U.S. PATENT DOCUMENTS

| | | | |
|---|---|---|---|
| 1,537,749 | 5/1925 | Colgrove | 226/115 |
| 2,626,449 | 1/1953 | Montgomery | 226/141 |
| 2,626,452 | 1/1953 | Gridley | 226/141 X |
| 3,083,391 | 4/1963 | Prange | 226/158 X |
| 3,477,627 | 11/1969 | Webers | 226/115 X |
| 3,583,268 | 6/1971 | Scribner | 226/162 X |
| 3,753,522 | 8/1973 | Voges | 226/150 X |
| 3,863,823 | 2/1975 | Allred | 226/142 |
| 3,967,768 | 7/1976 | Previati | 226/115 |
| 4,059,212 | 11/1977 | Ledgerwood | 226/141 |
| 4,353,162 | 10/1982 | Van Meteren | 226/112 X |
| 4,406,390 | 9/1983 | Hamilton | 226/115 X |

FOREIGN PATENT DOCUMENTS

| | | | |
|---|---|---|---|
| 964767 | 5/1957 | Fed. Rep. of Germany | 226/158 |
| 1265106 | 10/1968 | Fed. Rep. of Germany . | |

*Primary Examiner*—Harvey C. Hornsby

*Attorney, Agent, or Firm*—W. G. Fasse; D. H. Kane, Jr.

[57] ABSTRACT

The invention relates to a gripper or clamp feed advance mechanism for sheet metal bands or profiled forms on presses, having two feed advance clamps or grippers on the feed-side of the press and having a spacing therebetween in the direction of adjustment, whereby the feed advance and return stroke may be carried out between two press strokes. The purpose of the invention is a feed advance mechanism which makes possible the easiest adjustment of the feed advance path and the direction as well as of the spacing between the feed advance clamps or grippers, with a minimal feed advance force and practically any desired material dimension. It is intended that the spacing between the feed advance clamps or grippers (5) which determines the advance and return stroke, is achieved synchroneously through the adjustment of the crank radii (13) of the crank drive (10, 21, 23) by a common adjustment member (12). The drive of the feed advance clamps or grippers (5) which are pre-adjusted to a certain spacing therebetween, is provided by a linear driving cylinder (15), and by a uniform rotational motion of the crank disks (10), which are each connected by crank rocker arms (23) to a respective carriage (4). This drive is converted into a sinusoidal motion by the crank drives on both sides.

12 Claims, 4 Drawing Figures

GRIPPER FEED ADVANCE MECHANISM FOR A PRESS OR THE LIKE

FIELD OF THE INVENTION

The invention relates to a gripper or clamp feed advance mechanism for sheet metal bands, sheet metal strips or profiled forms on presses, shearing cutters or the like. The mechanism has two feed clamps on the feed-in side of the press. The feed clamps are arranged at a distance from each other in the direction of adjustment whereby the feed advance and the return stroke may be carried out between two press strokes.

DESCRIPTION OF THE PRIOR ART

Feed advance mechanisms are known from the description of the prior art in German Patent Publication No. 1,265,106 wherein the two feed clamps are arranged next to each other perpendicular to the band. The feed advance paths of these mechanisms overlap, or they lie parallel side by side to each other. Hereby the bands are gripped respectively only on one side. This causes a one-sided load or stress on the guiding means and lateral forces, within certain limits, on the band to be advanced. Furthermore, it is difficult and troublesome to advance very narrow and thin bands.

This arrangement is not usable for profiled material, especially also round material. Furthermore, this arrangement necessitates a large structural width due to the side-by-side arrangement of the advance paths, and is therefore not suitable for small presses.

For this reason the construction of the above mentioned patent publication provides that the two feed advance clamps are arranged one behind the other in the feed advance direction, and that the feed paths thereof also lie one behind the other. However, the drive of the clamps requires a separate drive for each clamp, which requires a separate stop and a separate damping system for each clamp. In combination, this results in a higher energy consumption for each clamp.

Moreover, it must be remembered relative to the two abovementioned systems that the material to be transported must be linearly accelerated and decelerated. This necessitates an increased clamping or holding force of the clamps, so that the advanced material does not slip further in the holding clamps during the deceleration after a completed feed advance stroke, whereby the required feed advance tolerance may not be satisfied anymore.

Moreover, it must be considered that these mechanisms basically require a high feed advance force due to their linear acceleration.

OBJECTS OF THE INVENTION

In consideration of the foregoing, it is the object of this invention to provide a gripper feed advance mechanism of the initially described type, which in the simplest manner allows the adjustment of the feed advance path and its direction, as well as the distance between the feed advance clamps from each other, with a minimal feed advance force, for practically any desired band or strip width and thickness and likewise for bands of any desired shape or form.

SUMMARY OF THE INVENTION

For achieving this object, it is provided that the pre-adjustable distance between the two feed advance clamps determines the adjustable length of the feed advance path, and the feed advance and return stroke motions of both clamps are controlled in common by drive means which are reversible in their direction of motion.

Due to the combination of the adjustment of the feed advance path and of the spacing between the two feed advance clamps, a double adjustment is no longer necessary, since the spacing determines the feed advance path which depends on the spacing. Stated differently, the separate adjustment of the advance and return stroke path and of the spacing between the clamps is no longer necessary.

Moreover, the use of directionally reversible, individually controlled drive means for carrying out the advance and return stroke motions, reduces not only the hereby resulting structural expenditure but also the energy requirement.

The construction of the mechanism provides that the spacing between the carriages which are attached to the feed advance clamps is adjustable in a synchronized, converging or diverging manner by means of two crank assemblies arranged on parallel axes in a rigid arrangement with respect to each other. The crank radii of the crank assemblies are adjustable by a common adjustment means. The crank rocker arms of the crank assemblies are each attached to a respective carriage pivot bearing arranged on each carriage. The feed advance clamps, which are adjusted in their spacing from each other, are driven by at least one drive cylinder which is glidingly guided in a constant-stroke manner on a rigidly arranged piston rod and is effective between the stationary piston rod and an endless drive. The endless drive is effective on each of two sprocket wheels on shafts connecting the respective sprocket wheel to the corresponding crank drive. The crank drive is applied to the respective carriage by the respective crank rocker arm. The crank drive provides a sinusoidal velocity characteristic.

The adjustment of the spacing between the two feed advance clamps is thus achieved by the adjustment of the crank radii of the two crank drives arranged on parallel axes in a rigid arrangement with respect to each other. The adjustment of the crank stroke is also achieved by the same adjustment of the crank radii, that is, in a synchronized manner with the converging or diverging movement of the feed advance clamps.

The drive of the feed advance clamps is achieved by a pneumatic or hydraulic linear drive having a constant stroke, that is, with one or several working cylinders. The linear motion is converted into two rotational motions in the crank drives having the same rotational direction. The rotational motions cause a sinusoidal velocity pattern of the feed advance clamps during their feed advance and return strokes.

It is recommended to regulate the working medium, depending on the power requirement, in order to adjust an optimal drive power.

To achieve an increase of the feed advance performance, it is feasible to perform several feed advance strokes in succession, since in this system there is not any time or energy loss for the idle return stroke of the clamp or gripper. The performance or efficiency of this feed advance mechanism is thereby practically doubled, that is, the same stroke power is delivered, with less than half of the drive power needed in the initially mentioned mechanisms.

The drive power required for the transport is substantially reduced due to the sinusoidal acceleration and deceleration of the forward and return movements of the clamps caused by the crank drive. Thus, smaller drive cylinders may be selected and the clamping forces of the feed advance clamps or grippers may be kept lower.

It is suggested that the mechanism for adjusting the crank radii includes adjustment means with a shaft with a bevel gear at its end which meshes with two further bevel gears attached to screw shafts arranged perpendicularly to the axis of the shaft of the adjustment means. Each of the two screw shafts engages a slider which is guided in a slider groove in a crank disk. The slider carries the crank pivot bearing for the crank rocker arm.

The carriages attached to the feed advance clamps are arranged so that they may be moved without canting or tilting along a guide track which has a fixed position. Each carriage is provided with a carriage pivot bearing for engaging the end of the crank rocker arm opposite the crank disk.

Hereby, it is advantageously provided that each carrier is guided on a guide track having two parallel planar carrying surfaces. Each carriage has several support rollers engaging the guide track on both carrying surfaces. The carriage pivot bearing is arranged on an axis through the center of gravity of the carriage. The arrangement of the carriage pivot bearing on an axis through the center of gravity helps achieving a tiltless and cantless guiding.

For enabling an unhindered motion of the crank rocker arms relative to each other, each of the crank rocker arms comprises an offset section on its middle part. Each middle part is oriented in parallel to a line connecting the crank pivot bearings and the carriage pivot bearings.

To further safeguard the stroke determined by the constant stroke drive, each crank disk is equipped with two cams which may cooperate with a rigid stop, for limiting the crank swing or stroke.

As a further structural detail, it is suggested that two connectable and disconnectable drive cylinders are arranged to be effective in opposed directions between the two parallel runs of the endless drive. At every stroke of the drive cylinder or cylinders, independent of the direction of motion thereof, only one of the two feed advance clamps is activated for transporting.

Moreover, each feed advance clamp may be individually adjusted as desired, which provides the possibility of having different advance strokes, if desired. In this context, it is intended that each one of the two sliders which determine the crank radius and which may be adjusted by means of a chain sprocket and a screw shaft, may be disconnected from the common adjustment means by a clutch.

BRIEF FIGURE DESCRIPTION

The gripper or clamp feed advance mechanism according to the invention will be more closely described with reference to the accompanying drawings of an example embodiment.

Figure 2:
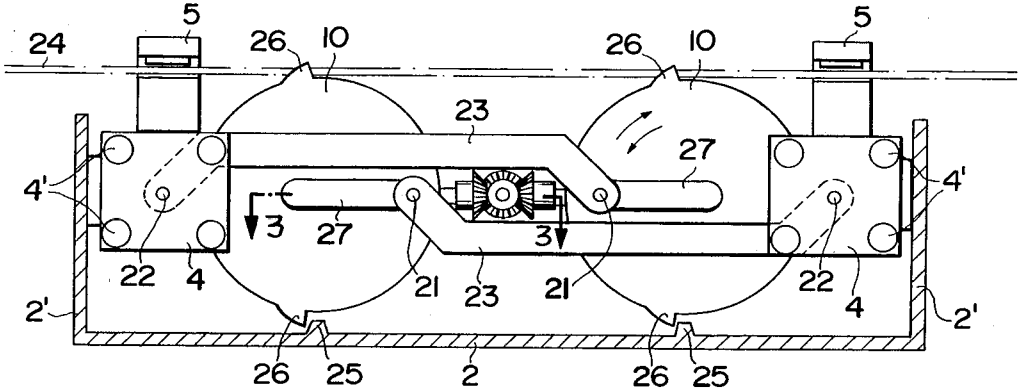
FIG. 2 shows a section through FIG. 1 sectioned along line 2—2, as an elevational view.
Figure 1:
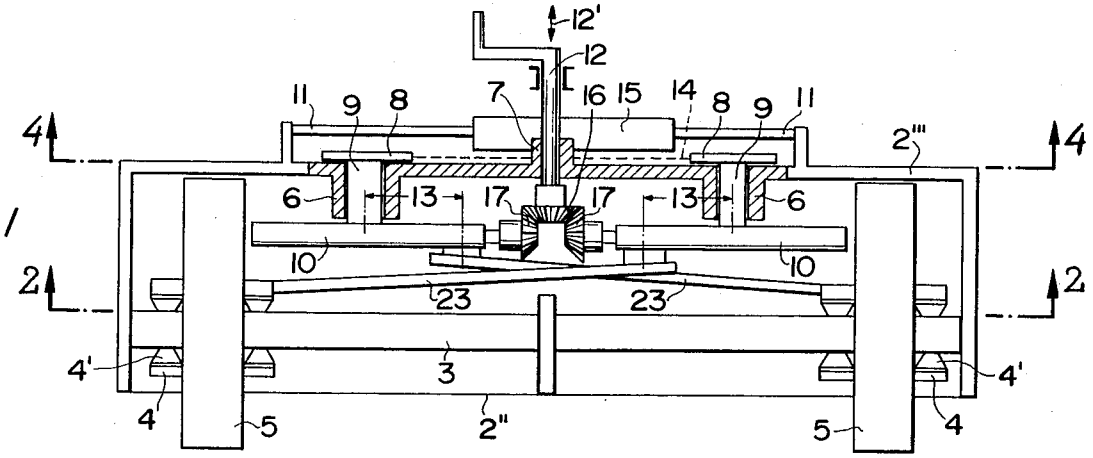
FIG. 1 shows an elevational view of the mechanism partially in section.
Figure 4:
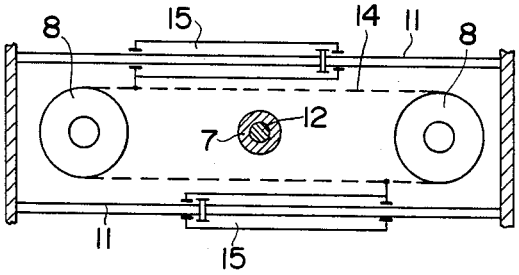
FIG. 4 shows the section 4—4 through FIG. 1, also as an elevational view, specifically showing the common drive of the adjustment mechanism for adjusting the crank radii.
Figure 3:
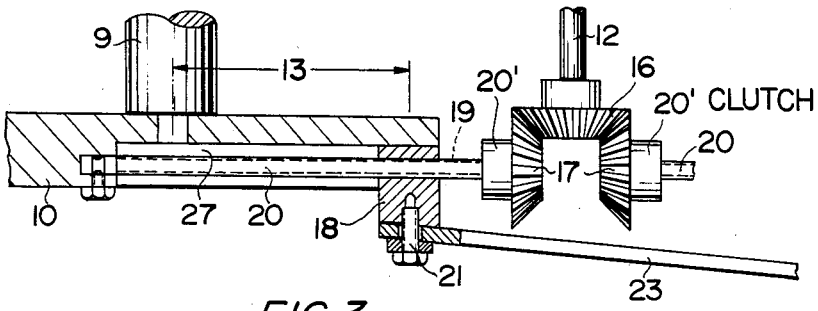
FIG. 3 shows a section of FIG. 2 sectioned along line 3—3 and illustrating on an enlarged scale the construction for position fixing and guiding of the crank rocker arms on the crank disks.

DESCRIPTION OF PREFERRED EXAMPLE EMBODIMENTS AND OF THE BEST MODE OF THE INVENTION

The clamp or gripper feed advance mechanism is arranged in a gear case 2 which functions as a frame or housing and which is open on one side in its plan view. A guide track 3 is arranged between the narrow end walls 2' in the area of the open side 2''. The guide track 3 supports at its top and bottom side. The guide track 3 is provided for the two carriages 4, which are each equipped with eight support rollers 4'. Furthermore, the carriages 4 are each connected to a feed advance clamp or gripper 5. The wall 2''' opposite the open side 2'' carries the drive for the adjustment mechanism of the crank radii 13. Three collar bearings 6, 7, 6 are arranged equally spaced in one plane in the wall 2''' and parallel to the bottom of the gear case 2. The outer collar bearings 6 are constructed for supporting the units of which each comprises a chain sprocket 8, a shaft 9, and a crank disk 10. The middle bearing 7 serves as a guide for the retractable adjustment member 12. The retractable adjustment member 12 serves for the common, synchronized, but opposedly directed adjustment of the size of the crank radii 13 of both crank disks 10. The two chain sprockets 8 are connected to a drive chain 14. A drive cylinder 15 is releasably connectable by respective conventional connecting means to each of the two runs of the endless drive chain 14. Each drive cylinder 15 is movable on a rigid, nonmovable piston rod 11 corresponding to the direction of motion of the respective chain run. Each drive cylinder 15 is reversed to drive in the opposite direction when it reaches its preset and position.

The adjustment member 12 has a bevel gear 16 attached to its end At a preset crank radius 13 and the hereby resulting maximum clamp separation distance, the bevel gear 16 engages bevel gears 17 which are arranged to have a common axis perpendicular to the axis of the adjustment member 12. The adjustment member 12 is axially movable as indicated by the double arrow 12' for engaging and disengaging the gears 16, 17. The bevel gears 17 are arranged to engage the bevel gear 16 on opposite sides.

The sliders 18 comprising threadings 19 are guided in slider grooves 27 of the crank disks 10. In this position, the slider grooves 27 extend in diametrically opposite directions relative to each other. The sliders 18 are each glidably adjustable in opposed directions by the screw shafts 20 connected with the bevel gears 17, preferably through a conventional clutch 20'.

Each of the sliders 18 forms a carrier of a crank pivot bearing 21 for the respective swingably arranged crank rocker arm 23. The crank rocker arms rock in opposed offset directions, that is one extends upwardly and the other extends downwardly. The respective other end of each of the crank rocker arms 23 is similarly rockably secured to a carriage pivot bearing 22 arranged on each carriage 4.

The construction of the feed advance clamps or grippers may be as desired and normally corresponds to elements known in this art.

Bands 24 of finite length may be transported from the left to the right or from the right to the left as desired, depending upon which clamp and which transport direction is activated.

A high feed advance precision is achieved by the rigid stops 25, which are arranged on the floor of the gear case 2, and the cams 26 which are each arranged on a crank disk 10.

I claim:

1. A gripper mechanism for feeding sheet metal bands, strips or profiled stock in a feed advance direction into a processing station, comprising housing means, two movable feed advance clamps spaced from each other in said feed advance direction by an adjustable spacing, two carriages, each carriage carrying on feed advance clamp, guide means mounted in said housing means for guiding the movement of said carriages of said feed advance clamps, direction reversible drive means supported by said housing means, two crank drive assemblies mounted in said housing means for transmitting driving power from said direction reversible drive means through said crank drive assemblies to said carriages to move said carriages in unison back and forth, said crank drive assemblies comprising two adjustable crank radius determining members, one member for each assembly, and crank radius adjustment means connected in common to both crank radius determining members for adjusting both crank radii in synchronism to make said spacing between said feed advance clamps larger or smaller, and wherein said crank radius adjusting means comprise a first bevel gear, adjustment means connected to said first bevel gear for rotating said first bevel gear, two second bevel gears arranged for meshing with said first bevel gear, two screw shafts operatively connected to said second bevel gears, each of said crank radius determining members having a threaded hole through which the respective one of said two screw shafts extends for rotating said screw shafts to thereby move said crank radius determining members along the respective screw shaft.

2. The mechanism of claim 1, wherein said crank drive assemblies comprise two parallel shafts rotatably mounted in said housing means with a fixed spacing between said two parallel shafts, two crank rocker arms, first pivot bearing means operatively connecting one end of each crank rocker arm to the respective carriage and second pivot bearing means operatively connecting the other end of each crank rocker arm to the respective crank radius determining member for transmitting crank movement to said carriages.

3. The mechanism of claim 2, wherein said carriages each have a respective center of gravity, and wherein said first pivot bearing means connecting said crank rocker arms to said carriages each have a pivot bearing axis extending through the center of gravity of the respective carriage.

4. The mechanism of claim 2, wherein each of said two crank rocker arms has an offset step in its middle part, said step being oriented in parallel to a line connecting the respective first and second pivot bearing means.

5. The mechanism of claim 1, wherein said crank radius adjusting means further comprise clutch means arranged for disconnecting the respective second bevel gear from its corresponding screw shaft.

6. The mechanism of claim 1, wherein each of said two crank drive assemblies comprises a crank disk with a slider groove in which the respective crank radius determining member is slidable back and forth driven by the respective one of said two screw shafts which in turn is driven by said first and second bevel gears through said first bevel gear.

7. The mechanism of claim 6, wherein each of said crank disks comprises two cams, said housing means comprising two rigid stops arranged in said housing means in positions for cooperation with the respective one of said two cams.

8. The mechanism of claim 1, wherein said guide means comprise one guide track for both carriages, said guide track being mounted in a fixed position in said housing means, said guide track holding both carriages without canting or tilting.

9. The mechanism of claim 8, wherein said one guide track comprises two parallel planar carrying surfaces, each carriage comprising several support rollers in contact with both carrying surfaces.

10. The mechanism of claim 1, wherein said direction reversible drive means comprise two sprocket wheels each mounted on a respective parallel shaft for transmitting torque to the respective crank drive assembly, an endless drive chain interconnecting said two sprocket wheels, and constant stroke piston cylinder means operatively connected to said drive chain and to said housing for moving said drive chain in one direction or in the opposite direction, whereby the operation of said crank drive assemblies cause a sinusoidal velocity characteristic.

11. The mechanism of claim 10, wherein for every stroke of said constant stroke piston cylinder means, independently of the direction of motion of said constant stroke piston cylinder means, only one of said two feed advance clamps is activated for transporting.

12. The mechanism of claim 10, wherein said direction reversible drive means comprise two drive cylinder piston devices arranged for driving said endless drive chain in opposite directions, and means for connecting and disconnecting said drive cylinder piston devices from said endless drive chain.

* * * * *